US007647797B1

(12) United States Patent
Viso Cabrera et al.

(10) Patent No.: US 7,647,797 B1
(45) Date of Patent: Jan. 19, 2010

(54) PROGRAMMABLE ELECTRONIC LOCK

(75) Inventors: Ana Viso Cabrera, Elgoibar (ES); Ramón Gabikagogeaskoa Sanchez, Elgoibar (ES); Beatriz Vierna Garcia, Elgoibar (ES)

(73) Assignee: Ojmar S.A., Guipuzcoa (ES)

( * ) Notice: Subject to any disclaimer, the term of this patent is extended or adjusted under 35 U.S.C. 154(b) by 0 days.

(21) Appl. No.: 12/178,756

(22) Filed: Jul. 24, 2008

(30) Foreign Application Priority Data

Jul. 2, 2008 (EP) ..... 08380192

(51) Int. Cl.
*E05B 13/00* (2006.01)

(52) U.S. Cl. ..... 70/208; 70/278.7; 70/283; 70/432; 292/144; 292/174; 292/DIG. 37

(58) Field of Classification Search ..... 70/208, 70/278.7, 283, 432, 277, 278.1, 278.2, 278.3, 70/279.1, 283.1; 292/144, 174, DIG. 37
See application file for complete search history.

(56) References Cited

U.S. PATENT DOCUMENTS 1,196,064 A * 8/1916 Zbytniewski et al ..... 292/170
2,546,703 A * 3/1951 Scanlan ..... 292/170
2,726,889 A * 12/1955 Lawson ..... 292/170
4,167,104 A * 9/1979 Bond ..... 70/208
4,633,687 A * 1/1987 Fane ..... 70/276
5,715,715 A * 2/1998 Nunez ..... 70/283
5,813,257 A * 9/1998 Claghorn et al. ..... 70/208
5,839,304 A * 11/1998 Wills ..... 70/175
6,363,762 B1 * 4/2002 Kueng ..... 70/278.3
6,427,505 B2 * 8/2002 Imedio Ocana ..... 70/422
6,575,503 B1 * 6/2003 Johansson et al. ..... 292/170
6,813,916 B2 * 11/2004 Chang ..... 70/257
7,194,881 B2 * 3/2007 Kutschat ..... 70/224
2005/0144994 A1 * 7/2005 Lies et al. ..... 70/278.2
2005/0199022 A1 * 9/2005 Friar et al. ..... 70/78
2006/0112747 A1 * 6/2006 Moon et al. ..... 70/283
2006/0185407 A1 * 8/2006 Priest et al. ..... 70/208
2006/0201214 A1 * 9/2006 Bantle ..... 70/278.7
2006/0248931 A1 * 11/2006 Boulard et al. ..... 70/208
2007/0240463 A1 * 10/2007 Antonucci ..... 70/208
2008/0271502 A1 * 11/2008 Kutschat ..... 70/224

FOREIGN PATENT DOCUMENTS

ES 2 229 929 4/2005

* cited by examiner

*Primary Examiner*—Lloyd A Gall
(74) *Attorney, Agent, or Firm*—Merchant & Gould P.C.

(57) ABSTRACT

A programmable electronic lock with a closing tongue is actuated with an actuating mechanism formed by a mobile knob acting as a button joined to the closing tongue. Actuation of the mobile knob generates a movement of the closing tongue and closure of the lock. Recovery of the mobile knob to its initial position generates an opening of the lock. Furthermore, an electronics board is activated with a transponder key and controls operation of the lock by deactivating and subsequently activating a blocking mechanism formed by a motor that actuates a punch via a gear mechanism. When the punch is in a blocking position it is located against the actuating mechanism. When the punch is in an unblocking position, it is separated from the actuating mechanism and allows the movement of the closing tongue by unblocking the actuating mechanism.

8 Claims, 3 Drawing Sheets

PROGRAMMABLE ELECTRONIC LOCK

TECHNICAL FIELD OF THE INVENTION

The invention belongs to the technical field of locks, more specifically electronic locks for doors such as lockers, and more specifically to electronic locks using a transponder key system to control their operation, in which it is not necessary for the key and the lock to come into contact, and which control blocking systems which prevent or allow opening the lock.

BACKGROUND OF THE INVENTION

There are currently different types of electronic locks applied in different types of doors, especially in locker doors and the like.

Contactless locks stand out among them, in which by means of transponder technology, a key communicates with an electronics board of the lock through an antenna without needing physical contact. These locks have an actuating mechanism including a knob for handling the mechanism and a blocking system which blocks or unblocks the actuating mechanism, allowing or preventing the movement of the tongue of the lock and therefore its opening or locking.

Patent ES 2 229 929, owned by the same applicant as this application, describes a contactless electronic lock of the previous type in which the blocking system has a motor controlled by an electronics board which allows or refuses the linear movement of the tongue when the actuating mechanism is acted on through the rotation of the knob. It is detected by means of a cell and a magnet arranged in the blocking system that said blocking system correctly blocks or unblocks the rotation of the knob. The drawback of this invention is that the linear movement of the tongue of the lock is only achieved by means of a rotational movement of the knob.

There is another technical solution belonging to the same applicant of this application for achieving the linear movement of the tongue with a linear movement of the knob, as a result of a button joined to said knob, and in which shafts of the tongue are introduced. The pressure of the button with the knob generates the transverse movement of the tongue and the closing of the lock, and the recovery of the knob as a result of a spring generates the opening of the lock. In this technical solution the blocking system has a solenoid actuated by an electronics board, and to which solenoid a shaft is fixed. For the blocking, the solenoid places the shaft against the button and for the unblocking, the shaft is withdrawn from the button. A hold-down plate of a contact at the end opposite the shaft fixed to the solenoid controls the correct operation of the lock. This technical solution has the drawback of a high probability of the solenoid breaking down, which affects the blocking of the actuating mechanism, and therefore renders the lock useless, making it necessary to repair or replace it, with the corresponding associated cost.

An electronic lock providing an efficient control and blocking system is therefore desired, preventing the drawbacks existing in the previous systems in the state of the art.

SUMMARY OF THE INVENTION

The invention solves the problems existing in the state of the art by means of a battery-powered programmable electronic lock and which inside a casing with a cover has a tongue with two side shafts. In the opening position of the lock, the tongue remains inside the casing and in the closing position of the lock, the tongue moves linearly and partially exits said casing, abutting against a frame and preventing the opening of the door.

The tongue is actuated by an actuating mechanism, which along a guide axis perpendicular to the casing and the tongue, has a mobile knob, which has side grooves in which the two side shafts of the tongue are introduced, the tongue and the mobile knob being kinematically joined together. There is also a first spring for the recovery of the mobile knob along the guide axis.

By means of this configuration, the pressure on a mobile knob exerted by a user generates a linear movement of the mobile knob, and when the latter is moved, the tongue partially exits the casing, its shafts sliding through the grooves of said mobile knob, the lock reaching its closing position.

In contrast, when there is no pressure on the knob, and the actuating mechanism is not blocked, the recovery movement of the mobile knob, due to the action of the first spring, generates the entry of the tongue into the casing, reaching the opening position of the lock.

The lock additionally has inside the casing an electronics board which is activated by means of the button, and which emits a signal by means of an antenna, and which is received by a transponder key, the electronics board communicating with said key, and controlling the operation of the electronic lock, mainly by activating and deactivating a blocking mechanism of the actuating mechanism, which unblocks the latter and allows the movement of the tongue and the passage therefore of the lock to its opening position, the blocking mechanism subsequently being actuated by the electronics board after the actuating mechanism moves the tongue again to the closing position, thus blocking the actuating mechanism and preventing the movement of the tongue.

The antenna is preferably arranged along the guide axis of the actuating mechanism, and it can be a conventional coil, or an antenna integrated in a printed circuit board.

The blocking mechanism is formed by a motor which is controlled by the electronics board, which, by means of a gear system, actuates a punch. Said punch, in a blocking position, is arranged against the actuating mechanism, blocking it and therefore preventing the movement of the tongue, and in an unblocking position, it is separated from the actuating mechanism, unblocking it and allowing the movement of the tongue.

To block the actuating mechanism, the punch can be fixed, according to a particular embodiment of the invention, on the surface of the button preventing its return movement. It thus blocks the actuating mechanism and prevents the movement of the tongue. In an unblocking position, the punch is withdrawn from the surface of the button and its return movement is thus allowed, pushed by the second spring, releasing the actuating mechanism and allowing the movement of the tongue.

According to an alternative embodiment, the punch is fixed on a recess made in the surface of the button, preventing the sliding of the punch on the surface and making the blocking more secure.

Optical detectors in the electronics board detect at all times the exact position of the punch and transmit it to the microcontroller of the electronics board so that it can have suitable control over the control mechanism, and can stop the latter when it reaches its extreme positions.

BRIEF DESCRIPTION OF THE DRAWINGS

An embodiment will be described below by way of an illustrative but non-limiting description in relation to a series of drawings.

Figure 1:
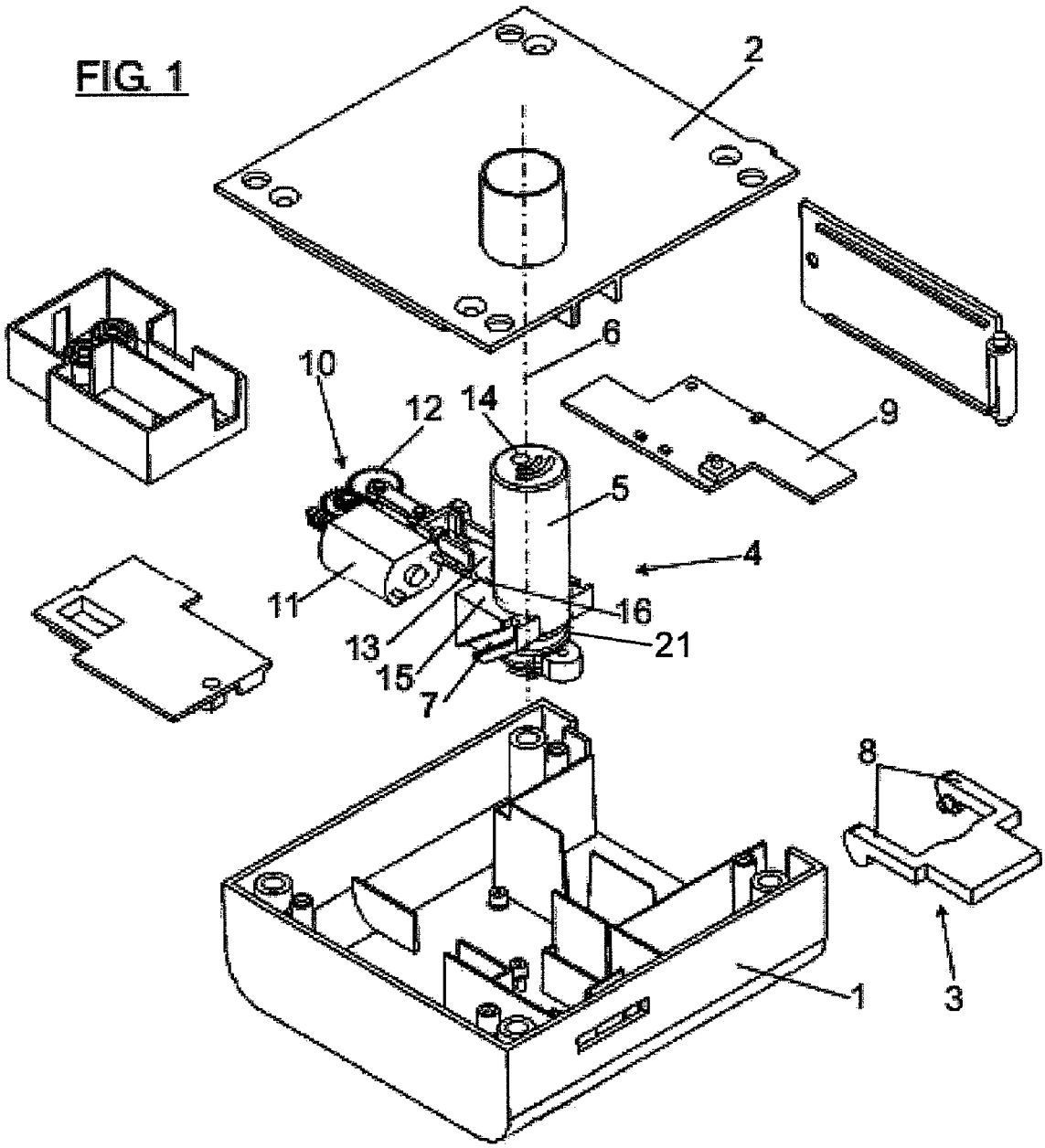
FIG. 1 is an exploded perspective view of an electronic lock object of the invention.

The following set of elements is referred to in these drawings:

1. casing
2. cover of the casing
3. tongue
4. actuating mechanism of the tongue
5. mobile knob
6. guide axis of the actuating mechanism
7. side grooves
8. shafts of the tongue
9. electronics board
10. blocking mechanism
11. motor of the blocking mechanism
12. gear system of the blocking mechanism
13. punch of the blocking mechanism
14. antenna
15. surface of the mobile knob
16. recess in the upper surface of the mobile knob
17. optical detectors
18. battery
19. second spring
20. controller of the battery charge level
21. first spring

DETAILED DESCRIPTION OF PREFERRED EMBODIMENTS

As can be seen in the figures, the object of the invention is an electronic lock having a casing 1, closed by a cover 2, the main elements of said lock being inside the casing 1.

The lock has a tongue 3, which in the opening position of the lock remains inside the casing 1, and in the closing position of said lock moves linearly and partially exits the casing 1, abutting against a frame, and preventing the opening of the door in which the lock is located.

This tongue 3 is actuated by an actuating mechanism 4 having, along a guide axis 6 perpendicular to the casing 1 and the tongue 3, a mobile knob 5. The mobile knob 5 has side grooves 7 in which shafts 8 existing in the sides of the tongue 3 are introduced, the mobile knob 5 and the tongue 3 being kinematically connected. Additionally there is arranged along the guide axis 6 a first spring 21 for the recovery of the mobile knob 5 once it is moved.

By means of this configuration, the pressure on the mobile knob 5 by a user makes the side shaft 8 of the tongue 3 slide along the side grooves 7 of the mobile knob 5 and moves linearly, partially exiting the casing 1 and the lock being in the closing position. Subsequently, the linear recovery movement of the mobile knob 5 generates the sliding in the opposite direction of the tongue 3 and its entry into the casing 1, the lock being in the opening position.

The electronic lock is controlled by an electronics board 9 receiving data from a transponder key through an antenna 14. This electronics board 9 activates and deactivates a blocking mechanism 10 of the actuating mechanism 4, which unblocks said actuating mechanism 4 and allows the movement of the tongue 3 and the passage of the lock to its opening position. Subsequently, once the actuating mechanism 4 moves the tongue 3 again to the closing position of the lock, the electronics board 9 again actuates the blocking mechanism 10 which blocks the actuating mechanism 4 and prevents the movement of the tongue 3, keeping the lock in the closing position. This electronics board 9 is reprogrammable according to different operation modes.

With regard to the antenna 14, the antenna either consists of a conventional coil or it is integrated in a printed circuit board.

This blocking mechanism 10 is formed by a motor 11 controlled by the electronics board 9, which by means of a gear system 12 actuates a punch 13. This punch 13, in the blocking position, is placed against the actuating mechanism 4 and blocks it, preventing the movement of the tongue 3. In contrast, in the unblocking position, the punch 13 is separated from the actuating mechanism 4 unblocking the latter and allowing the movement of the tongue 3.

According to a preferred embodiment of the invention, to carry out the blocking position, the punch 13 of the blocking mechanism 10 is located in a recess 16 made in the surface 15 of the mobile knob 5, preventing its return movement, and thus blocking the actuating mechanism 4 and preventing the movement of the tongue 3. To switch to the blocking position of the punch 13, the motor 11 of the blocking mechanism 10 actuates the gear system 12, which acts on said punch 13, withdrawing the latter from the recess 16 of the surface 15 of the mobile knob 5 allowing its return movement and therefore allowing the movement of the tongue 3.

The blocking mechanism 10 preferably has a second spring 19 which is arranged in the shaft of the punch 13, in contact with the latter, allowing it to carry out a recovery movement if it meets any obstacle in its travel, thus preventing possible jams of the blocking mechanism 10.

Figure 2:
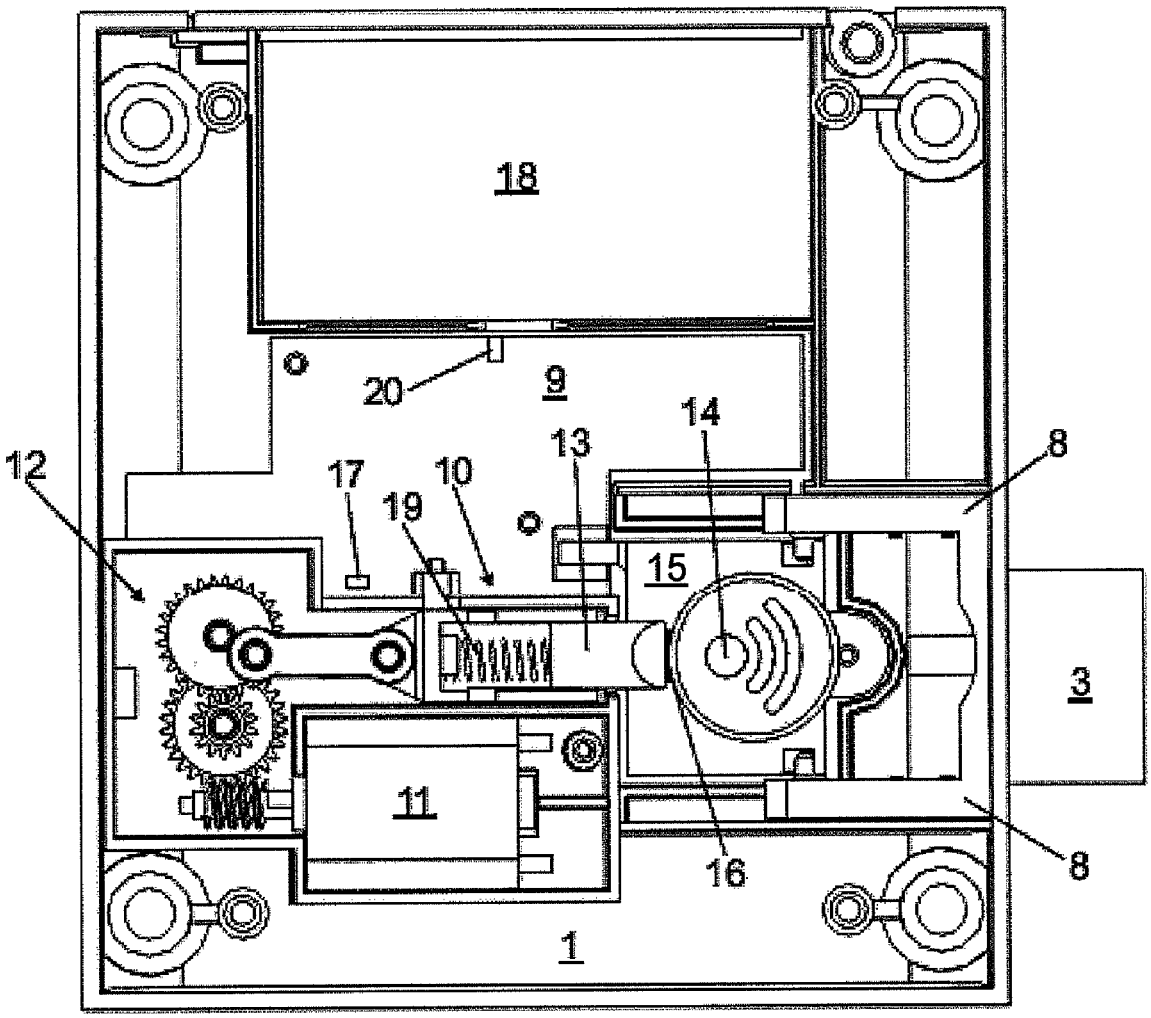
FIG. 2 is a plan view of the electronic lock of FIG. 1 without the cover of the casing so that the internal elements can be observed.
Figure 3:
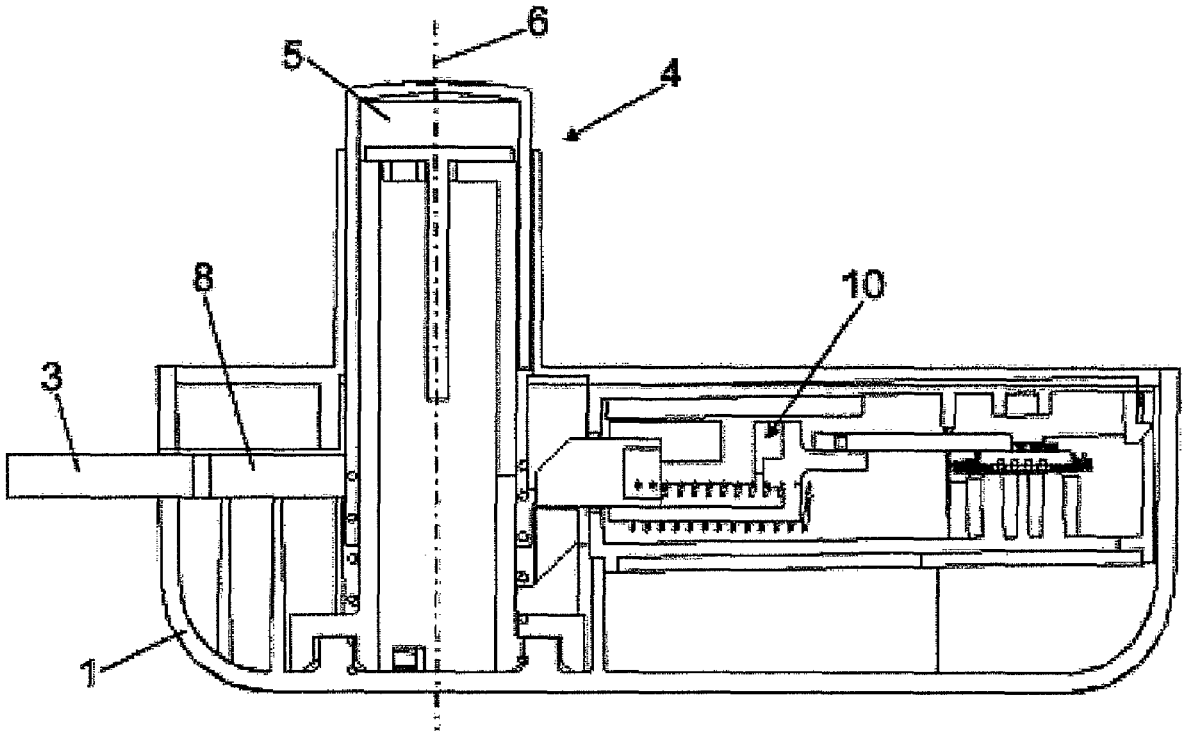
FIG. 3 shows an elevational section view of the lock of FIGS. 1 and 2.

In order for the electronics board 9 to be able to give the corresponding run and stop orders to the blocking mechanism 10, in the proximity of this blocking mechanism 10 there are optical detectors 17, as can be seen in FIG. 2, which detect at any time the exact position of the punch 13 and the electronics board 9 knows the exact moment in which it has to order the motor 11 to stop its actuating movement of the punch 13.

The electronic lock is battery-powered, and according to a preferred embodiment of the invention, the electronics board 9 has a battery charge level controller 20, such that it prevents the movement of the actuating mechanism 4 of the tongue 3 to the closing position of the lock when this controller 20 detects that the charge level is under a certain value, to prevent the lock from being left without battery power during its closing position and cannot open.

Having clearly described the invention, it is hereby stated that the particular embodiments described above are susceptible to modifications of their details provided that such modifications do not alter the essential principle and essence of the invention.

The invention claimed is:

1. A programmable electronic lock arranged in a casing with a cover, comprising:

a battery;

a tongue with two side shafts, which in an opening position of the lock remains inside the casing, and in a closing position of the lock moves linearly and partially exits the casing, wherein the linear movement of the tongue defines a longitudinal tongue axis;

an actuating mechanism configured to actuate the tongue, the actuating mechanism located along a guide axis perpendicular to the longitudinal tongue axis:

a mobile knob comprising side grooves in which the two side shafts of the tongue are introduced, and a first spring for the recovery of the mobile knob, wherein pressure of the mobile knob generates partial exit of the tongue from the casing and the closing position of the lock, and recovery movement of the mobile knob generates entry of the tongue into the casing and the opening position of the lock;

an antenna;

an electronics board configured for receiving data emitted by a transponder key through the antenna, the electronics board controlling the operation of the electronic lock and activating and deactivating; and a blocking mechanism of the actuating mechanism, which unblocks the latter allowing the movement of the tongue and the passage of the lock to its opening position, the blocking mechanism being subsequently actuated by the electronics board after the actuating mechanism moves the tongue again to the closing position, thus blocking the actuating mechanism and preventing the movement of the tongue, wherein the blocking mechanism comprises a motor controlled by the electronics board which actuates a punch by means of a gear system, which in a blocking position is located against the actuating mechanism, blocking the latter and preventing the movement of the tongue, and in an unblocking position is separated from the actuating mechanism, unblocking the latter and allowing the movement of the tongue.

2. The programmable electronic lock according to claim 1, wherein the punch of the blocking mechanism in its blocking position is fixed in a recess made in a surface of the mobile knob, preventing its return movement, thus blocking the actuating mechanism and preventing the movement of the tongue, and in its unblocking position is withdrawn from the recess made in the surface of the mobile knob, driven by the gear system which is actuated by the motor, allowing the return movement of said mobile knob, and thus releasing the actuating mechanism and allowing the movement of the tongue.

3. The programmable electronic lock according to claim 1, wherein the electronics board is reprogrammable according to different operation modes.

4. The programmable electronic lock according to claim 1, further comprising optical detectors arranged in the proximity of the blocking mechanism which detect at any time the exact position of the punch and transmit it to the electronics board for the control of said blocking mechanism.

5. The programmable electronic lock according to claim 1, wherein the electronics board comprises a controller of the battery charge level and prevents the movement of the tongue to the closing position of the lock when it detects that the battery charge level is under a predetermined value.

6. The programmable electronic lock according to claim 1, wherein the antenna consists of a conventional coil.

7. The programmable electronic lock according to claim 1, wherein the antenna is integrated in a printed circuit board.

8. The programmable electronic lock according to claim 1, wherein the blocking mechanism comprises a second spring arranged in a shaft of the punch, in contact with the latter.

* * * * *